US010710390B2

(12) United States Patent
Good-Man

(10) Patent No.: US 10,710,390 B2
(45) Date of Patent: Jul. 14, 2020

(54) MAGNETICALLY BOUND MEDIUM WITH REATTACHABLE PAGES

(71) Applicant: Charles Good-Man, Aliso Viejo, CA (US)

(72) Inventor: Charles Good-Man, Aliso Viejo, CA (US)

( * ) Notice: Subject to any disclaimer, the term of this patent is extended or adjusted under 35 U.S.C. 154(b) by 202 days.

(21) Appl. No.: 15/872,327

(22) Filed: Jan. 16, 2018

(65) Prior Publication Data

US 2018/0154673 A1 Jun. 7, 2018

Related U.S. Application Data

(63) Continuation-in-part of application No. 14/178,465, filed on Feb. 12, 2014, now Pat. No. 9,902,184.

(Continued)

(51) Int. Cl.
*B42F 11/04* (2006.01)
*B42D 1/06* (2006.01)

(Continued)

(52) U.S. Cl.
CPC ..... *B42D 1/06* (2013.01); *B42D 1/008* (2013.01); *B42D 13/00* (2013.01); *B42F 11/04* (2013.01);

(Continued)

(58) Field of Classification Search
CPC ..... B42F 11/04

(Continued)

(56) References Cited

U.S. PATENT DOCUMENTS 2,547,948 A 4/1951 Komei
3,145,326 A * 8/1964 McGannon ..... B42F 11/04 335/285

(Continued)

FOREIGN PATENT DOCUMENTS

CH 262173 A * 6/1949 ..... B42F 11/04
EP 2687382 A1 * 1/2014 ..... B42F 11/04

(Continued)

OTHER PUBLICATIONS

FR 1,045,406 English Translation (Year: 1953).*
EP 2,687,382 English Translation (Year: 2013).*

*Primary Examiner* — Kyle R Grabowski
(74) *Attorney, Agent, or Firm* — Jafari Law Group, Inc.

(57) ABSTRACT

The present magnetically bound media with reattachable pages exemplarily comprise a magnetic binding, one or more reattachable pages, and one or more conductive metals attached to the pages and magnetically attracted to the magnetic binding. Thus, a user of the magnetically bound media may disengage one or more of the pages from the magnetic binding and reintegrate those pages into the magnetic binding in any order. This allows for customization of information presentation, sequence, and selection. The small size of the magnetic binding also affords a smaller minimum apparatus size and a quicker means with which to remove, rearrange, and reintegrate pages. Furthermore, the magnetic binding permits pages to be secured in a more professionally presentable manner without punched holes. In an exemplary embodiment, the magnetic binding is a cylindrical or a prismatic, rectangular neodymium or samarium alloy secured within the bound media by a magnet cover or clasp.

18 Claims, 9 Drawing Sheets

Related U.S. Application Data

(60) Provisional application No. 62/484,970, filed on Apr. 13, 2017.

(51) Int. Cl.

| | |
|---|---|
| ***B42D 1/00*** | (2006.01) |
| ***D21H 17/63*** | (2006.01) |
| ***D21H 21/14*** | (2006.01) |
| ***B42D 13/00*** | (2006.01) |
| *D21H 27/00* | (2006.01) |

(52) U.S. Cl.
CPC ..... *D21H 17/63* (2013.01); *D21H 21/14* (2013.01); *D21H 27/00* (2013.01)

(58) Field of Classification Search
USPC ..... 281/27.3
See application file for complete search history.

(56) References Cited

U.S. PATENT DOCUMENTS

| | | | | |
|---|---|---|---|---|
| 3,751,839 | A | 8/1973 | Mitchell | |
| 4,234,378 | A | 11/1980 | Iwasaki | |
| 4,466,639 | A | 8/1984 | Finnegan | |
| 4,588,209 | A | 5/1986 | Zebrowski | |
| 4,948,463 | A | 8/1990 | Kinsley | |
| 5,048,869 | A | 9/1991 | Schwartz | |
| 5,380,043 | A | 1/1995 | Schwartz | |
| 5,575,503 | A | 11/1996 | Takahashi | |
| 5,709,409 | A | 1/1998 | Engle | |
| 6,273,660 | B1 | 8/2001 | Ozgen | |
| 6,793,251 | B2 | 9/2004 | Stark | |
| 6,940,377 | B1 | 10/2005 | Martin | |
| 7,744,128 | B2 | 6/2010 | El-Sorroge | |
| 8,289,352 | B2 | 10/2012 | Vartanian | |
| 9,987,869 | B2 * | 6/2018 | Thibierge | B42D 1/06 |
| 2007/0226069 | A1 | 9/2007 | Sanchez | |
| 2007/0252377 | A1 | 11/2007 | El-Sorroge | |
| 2009/0017334 | A1 | 1/2009 | Kurihara | |
| 2012/0200074 | A1 | 8/2012 | Kuch | |
| 2013/0176091 | A1 | 7/2013 | Lancaster-Larocque | |
| 2014/0125047 | A1 | 6/2014 | Thibierge | |

FOREIGN PATENT DOCUMENTS

| | | | | | |
|---|---|---|---|---|---|
| FR | 1045406 | A | * | 11/1953 | B42F 11/04 |
| FR | 1331254 | A | * | 6/1963 | B42F 11/04 |
| FR | 2592837 | A3 | * | 7/1987 | B42D 1/08 |
| GB | 631466 | A | * | 11/1949 | B42F 7/00 |
| WO | 2012175821 | | | 12/2012 | |
| WO | WO-2012175821 | A1 | * | 12/2012 | B42D 1/06 |

* cited by examiner

MAGNETICALLY BOUND MEDIUM WITH REATTACHABLE PAGES

PRIORITY NOTICE

The present application claims priority under 35 U.S.C. § 119 to U.S. Provisional Application 62/484,970, filed Apr. 13, 2017 and is a continuation-in-part of, and claims priority under 35 U.S.C. § 120 to, U.S. Non-Provisional application Ser. No. 14/178,465, filed on Feb. 12, 2014, the disclosure of the applications above incorporated herein by reference in their entirety.

TECHNICAL FIELD OF THE INVENTION

The present invention relates in general to a magnetically bound medium with reattachable pages, and more specifically, to a medium such as a notebook, which includes a magnetic binding and a plurality of pages adapted to magnetically bind to the binding so that each page may be detached and reattached from the medium.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Bound media, or media which makes use of a binding to hold together one or more pages, is an incredibly valuable means with which to store information. This media can be highly structured and order specific. Books, for instance, typically follow a standard order, usually beginning with a table of contents, and thereafter comprising any number of pages often broken up into subsections or chapters before the book ends. The information within the books typically progress linearly, as reading material generally follows from preceding information and leads into forthcoming information.

However, currently existing bound mediums, including books, journals, or textbooks, cannot address the problem that arises when one or more pages are either mistakenly or purposefully removed from the medium, yielding disjointed information. Traditional binding is designed to keep pages bound within a medium, but is not equipped to allow for reattachment, replacement, or rearrangement of pages should a page disengage from that binding.

To illustrate the problem, imagine a schoolbook. Schoolbooks are often reused for a number of years and utilized by a plethora of students. Understandably, pages may become ripped out or otherwise damaged over the years. Presently, no plausible solution exists to restore the schoolbook to its former condition. It may be possible to purchase individual pages, though these pages cannot simply be integrated into the completed binding. Thus, students may be forced to learn material with crucial information absent from the schoolbook. Alternatively, the school may be forced to purchase an entirely new schoolbook.

Another issue that may arise with a typical bound medium is when an individual such as a student, a business person or a professional uses or creates such a medium to give a presentation. For example, a professional wishing to bind a presentation to enhance the look or make it appear polished may, after binding, decide to present the information in a different order, but may have to fumble through the bound pages to present in the desired order. The rigid binding may not allow the individual to alter the presentation's order so as to present it in a logical and linear fashion.

One solution to the issue illustrated above may be to use a ringed binder, thus allowing for the order of pages in a presentation to be rearranged. For example, the three rings may be opened at their peak to allow for removal and rearrangement of pages. However, such binders are necessarily large and bulky irrespective of the number of pages they may contain. Rearrangement of pages in a ringed binder is slow and cumbersome, as it requires manually opening the rings, taking out a page, closing the rings, finding the appropriate spot to insert the detached page, opening the rings, and finally reinserting the page. Moreover, pages in a ringed binder are likely to tear over time in the areas where the holes are punched in the pages. Eventually, when such tears reach the edge of the page, the page may no longer be secured by the ringed binder and the binder's utility is severely diminished. Additionally, the requirement that such pages be three-hole punched severely limits the professional applicability of the ringed binding, as books and other similar media are seldom if ever three-hole punched. Instead, they are unadulterated and permanently bound, thus reintroducing the problems first presented.

There is a need in the art to address the issues discussed thus far. It is to these ends that the present invention has been developed, i.e. magnetically bound media allowing for a combination of the unadulterated, professional look of traditional binding, and the customizable and reattachable functionality of ringed binding. It is to these ends that the present invention has been developed.

SUMMARY OF THE INVENTION

To minimize the limitations in the prior art, and to minimize other limitations that will be apparent upon reading and understanding the present specification, the present invention describes a magnetically bound medium with reattachable pages.

Generally, the present invention concerns a customizable notebook/binder with removable/reattachable magnetized pages. The magnetic medium may feature a magnetic spine that the pages hold onto, until a user is ready to remove them. A user can pull out a page to scan, and put it right back in. Users can add clean pages, or swap them all out for blank, lined, graph, or dotted sheets. Moreover, the present invention presents a convenient solution for those with a variety of needs: students, artists, designers, mathematicians, writers, professionals, entrepreneurs, creatives, and most especially, those who fall somewhere among all of those. The elements discussed below are an improvement over any existing prior art that may mention using rare earth magnets inside a notebook/binder or other medium. These novel elements may include: a diametrically magnetized cylinder or magnetic tube, a covering hinge mount, and a spine clamp.

A magnetically bound medium, in accordance with one exemplary embodiment of the present invention, comprises: a cover including a channel for receiving a magnetic tube assembly, the magnetic tube assembly comprising: a tubular enclosure; a diametrically magnetized cylinder housed within the tubular enclosure, wherein the magnetized cylinder includes a plurality of plastic spacers in-between a plurality of diametrically magnetized cylindrical magnets; and a hinge mount including a cavity for receiving the tubular enclosure, the hinge mount further including planar supports adjacent to and extending from a length along opposite ends of the cavity; a spine clamp configured to engage with the channel of the cover and secure the magnetic tube assembly; and a plurality of magnetic sheets of paper, each magnetic sheet including a ferrous strip configured to magnetically register with a surface of the magnetic tube assembly.

A magnetically bound medium, in accordance with another exemplary embodiment of the present invention, comprises: a magnetic binding; one or more reattachable pages; and an adhered component integrated with the one or more reattachable pages, wherein the adhered component is magnetically attracted to the magnetic binding.

A magnetically bound medium, in accordance with yet another exemplary embodiment of the present invention, comprises a magnetic binding that includes a support structure, a diametrically magnetized magnet, and a cover for securing the magnet to the support structure. Furthermore, the bound medium includes one or more reattachable pages; and an adhered component integrated with each of the one or more reattachable pages, wherein the adhered component is magnetically attracted to the magnetic binding.

A magnetically bound book in accordance with yet another embodiment of the present invention comprises: a front cover; a back cover; a magnetic binding situated between the front and back covers, the magnetic binding further comprising: a support structure, a cylindrically shaped diametrically magnetized magnet, and a clasp for securing the cylindrically shaped diametrically magnetized magnet to the support structure. Furthermore, the book includes one or more reattachable pages, and a magnetizable powder adhered to each of the one or more reattachable pages, wherein the magnetizable powder is magnetically attracted to the magnetic binding of the magnetically bound book.

A page for a magnetically bound medium, in accordance with one embodiment of the present invention, comprises a sheet body, which contains a pulp fiber, said pulp fiber comprising: a first portion of organic material; a second portion of inorganic material; and a third portion of a magnetic component, wherein the first, second and third portions are integrated into a single mixture for forming the pulp fiber, wherein the magnetic component is distributed throughout the mixture, in a manner so as to spread the magnetic component towards an edge of the sheet body.

A method of making a magnetizable sheet for a magnetically bound medium, in accordance with practice of one embodiment of the present invention, comprises providing a pulp fiber for making one or more sheets of paper; creating a composition by mixing a first pulp solution obtained from the pulp fiber and integrating a magnetizable powder component with the first pulp solution; and processing the composition into a magnetizable sheet of paper, wherein processing the composition into a magnetizable sheet of paper further comprises: creating a second pulp solution from the pulp fiber, wherein the second pulp solution does not include the magnetizable component; and integrating the second pulp solution with the first pulp solution when creating the composition, in a manner so that the first pulp solution and the second pulp solution make two distinct areas of the composition, wherein only one of the distinct areas of the composition comprises the magnetizable component powder.

A magnetic notebook, in accordance with another exemplary embodiment of the present invention, comprises: a cover including a cylindrical channel along a spine of the cover; a magnetic tube assembly housed within the cylindrical channel, including: a tubular enclosure; a diametrically magnetized cylinder housed within the tubular enclosure, the diametrically magnetized cylinder including a plurality of spacers in-between a plurality of diametrically magnetized cylindrical magnets; a tubular spine clamp, with an elongated opening along a length of the tubular spine clamp, configured to snuggly receive the tubular enclosure within the elongated opening and engage with the cylindrical channel of the cover; and a hinge mount including a cavity for receiving the tubular enclosure; and a plurality of reattachable sheets of paper, each of the plurality of reattachable sheets of paper including a metallic strip configured to magnetically register with a surface of the magnetic tube assembly.

A magnetic notebook, in accordance with yet another exemplary embodiment of the present invention, comprises: a cover; a magnetic assembly housed within a channel of the cover, including a diametrically magnetized cylinder comprising a plurality of spacers in-between a plurality of diametrically magnetized magnets; and a plurality of reattachable sheets of paper, each of the plurality of reattachable sheets of paper including a metallic component configured to magnetically register with a surface of the magnetic assembly. In exemplary embodiments, each of the plurality of spacers is positioned between a pair of diametrically magnetized magnets having opposite directions of magnetic poles.

A magnetic notebook, in accordance with yet another exemplary embodiment of the present invention, comprises: a cover; a magnetic assembly housed within a channel of the cover, the magnetic assembly including: a plurality of diametrically magnetized magnets; a plurality of spacers in-between the plurality of diametrically magnetized magnets, wherein each of the plurality of spacers is positioned between a pair of diametrically magnetized magnets having opposite directions of magnetic poles; a spine clamp configured to engage with the channel of the cover; and a hinge mount including a cavity for receiving the plurality of diametrically magnetized magnets and the plurality of spacers in-between the plurality of diametrically magnetized magnets, and planar supports adjacent to the cavity, wherein the cavity of the hinge mount sits within an opening of the spine clamp and the planar supports are adhered to the cover with an adhesive; and a plurality of reattachable sheets of paper, each of the reattachable sheets of paper including a metallic strip configured to magnetically register with a surface of the magnetic assembly.

It is an objective of the present invention to enable removal and reattachment of pages to and from bound media so that the pages can be reassembled in any sequence.

It is another objective of the present invention to provide a more functional means of writing for both left and right-handed persons without the hassle of ringed notebooks and binders.

It is another objective of the present invention to decrease the overall size and minimum size of bound media.

It is yet another objective of the present invention to eliminate the hassle of removing pages from ring-bound media, including three-ringed binders and spiral notebooks.

Finally, it is yet another objective of the present invention to provide a faster means to remove and insert pages in bound media.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) depicts the specialized book shown in FIG. 1(*a*), now shown in an open position, revealing the magnetic binding that is configured to bind with the one or more magnetically reattachable pages.

FIG. 2(*b*) depicts a close-up perspective view of a page that has been adapted with an adhered component that comprises a magnetic strip, which has been adhered to the inner edge of the page, in accordance with an exemplary embodiment of the present invention.

FIG. 2(*c*) depicts a close-up side view of a page that has been adapted with an adhered component that comprises a magnetic material, which has been adhered to the inner edge of the page, in accordance with another exemplary embodiment of the present invention.

FIG. 2(*d*) depicts a close-up side view of a page that has been infused with a magnetic component, which has been integrated with the material from which the page is made, in accordance with another exemplary embodiment of the present invention.

FIG. 2(*e*) depicts a close-up side view of a page, a portion of which has been infused with a magnetic component, which has been integrated with the material from which the page is made, in accordance with another exemplary embodiment of the present invention.

FIG. 2(*f*) is a flowchart of a method for making a page for a magnetically bound medium, in accordance with practice of one embodiment of the present invention.

FIG. 5(*b*) depicts a perspective view of the magnetic notebook depicted in FIG. 5(*a*), the components of which are assembled.

FIG. 5(*c*) depicts a cross-sectional view of the magnetic notebook depicted in FIG. 5(*a*) and FIG. 5(*b*), the cross-sectional view along the line segment A-A.

FIG. 5(*d*) depicts the direction of magnetic poles of a plurality of magnets along a magnetic binding in accordance with an exemplary embodiment of the present invention.

DETAILED DESCRIPTION OF THE DRAWINGS

Figure 1A:
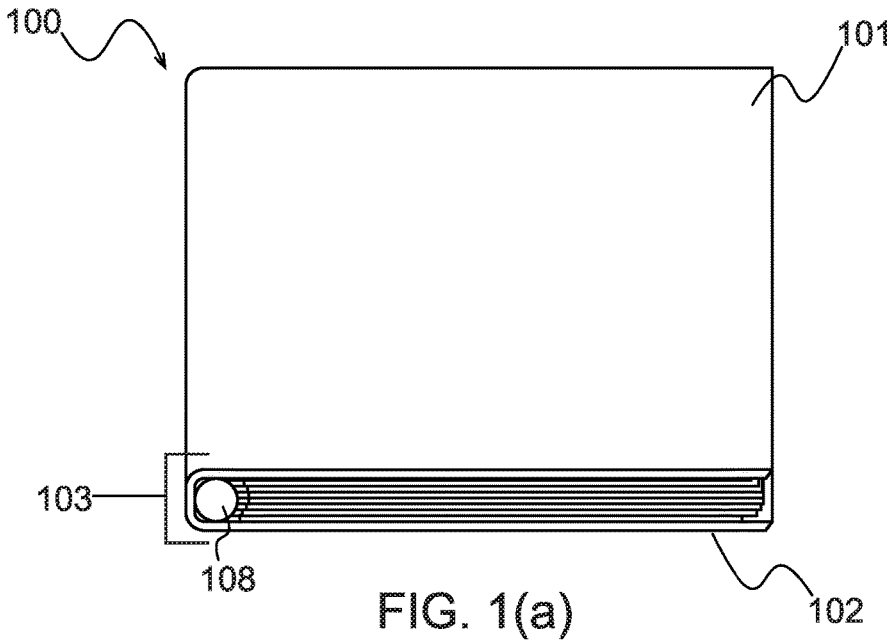
FIG. 1(*a*) depicts an example of a magnetically bound medium or a specialized book, comprising a magnetic binding and one or more magnetically reattachable pages, in accordance with an exemplary embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made, without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

In the present disclosure, a bound medium refers to a tangible medium of expression utilized to communicate or express ideas, wherein the medium utilizes a binding or bindings to hold together one or more pages. A binding may refer to a chemical or mechanical means for holding a written or pictorial medium together. Without limiting or deviating from the spirit or scope of the present invention, such a bound medium may refer to a book, notebook, notepad, binder, coloring book, novel, picture book, photo album, workbook, portfolio, presentation booklet, memo pad, journal, sketchbook, planner, ledger, pamphlet, or any other similar written or pictorial medium. Furthermore, it does not matter the manner in which the written or pictorial information is presented within the media. For example, photos, images, drawings, words, or any other information may be affixed to individual pages, written or drawn directly onto one or more pages, or displayed via a digital format onto one or more pages of the bound media. Hence, the present disclosure will discuss several examples of the present invention, but it is noted that other embodiments may be practiced and used, which are not specifically described herein.

A primary objective of the present invention is to provide users with the capacity to write, draw, or otherwise make use of a page on a bound medium, and be able to remove, reorganize, or replace pages that have at one point or another been removed. The present invention improves over the idea of detachable pages in that pages in the present invention may be reattached to the binding of the media once a page has been used, or once a new page is made available. More importantly, reattachment is achieved with a specialized magnetic binding that binds to each individual page, which is independently adapted to magnetically bind to the binding of the medium. The application ranges from enabling users to merely remove a page in order to take it with them, to replacing lost pages on books. Furthermore, reattachment is useful for other purposes such as updating information on new editions of books and more generally, offering a versatile manipulation of the content within the medium. Because the medium, in accordance with the present invention, does not require the use of rings or latches to open and release each individual page, each page may be easily positioned in a desired order within the medium, without having to reorganize or remove superfluous pages.

Figure 1B:
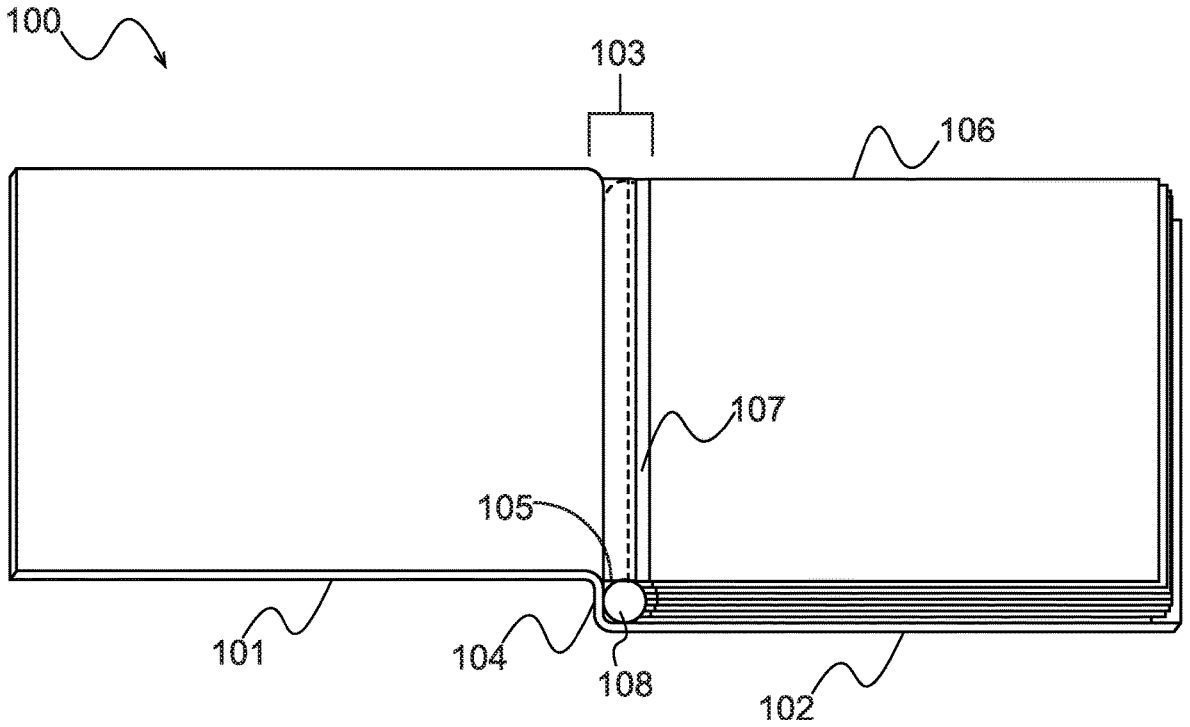
Figure 2A:
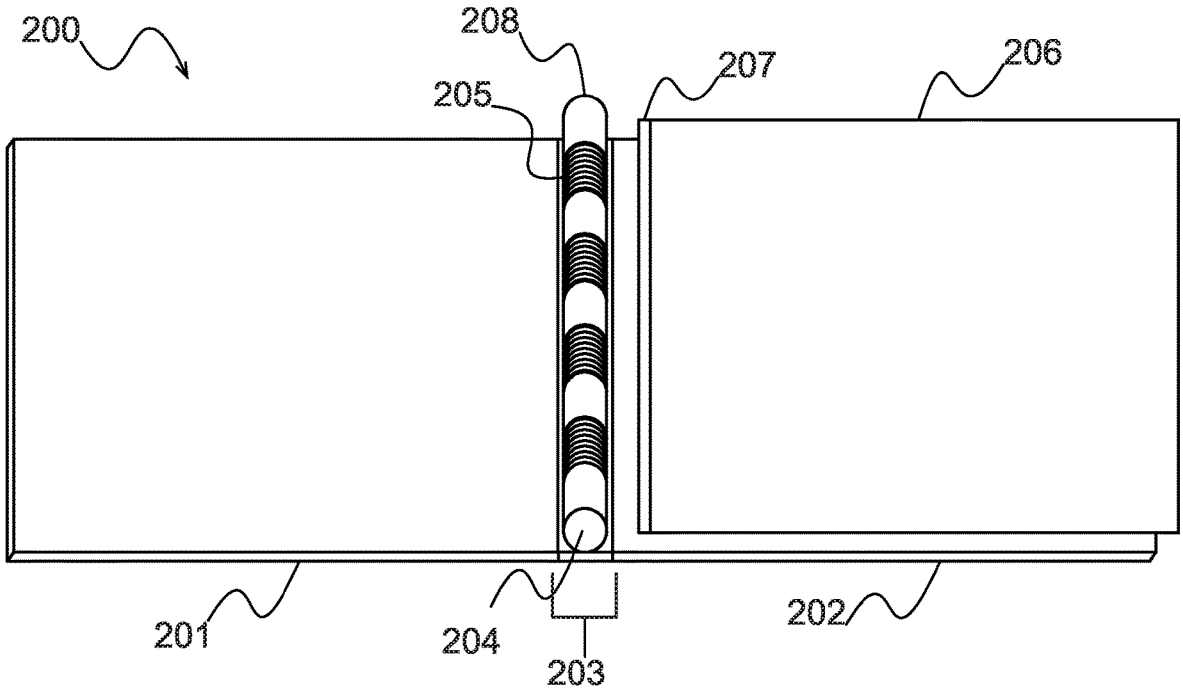
FIG. 2(*a*) depicts another example of a magnetically bound medium, in accordance with another exemplary embodiment of the present invention.
Figure 2B:
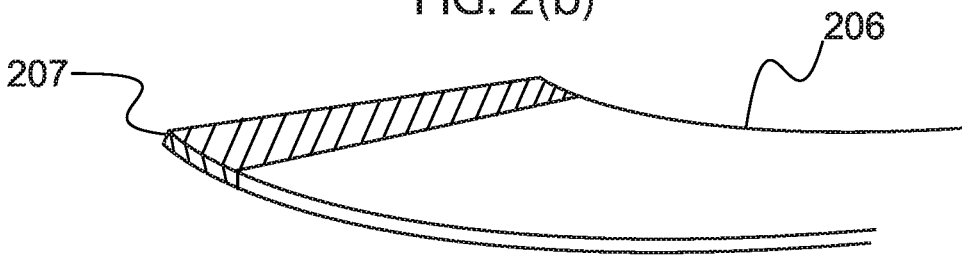
Figure 2C:
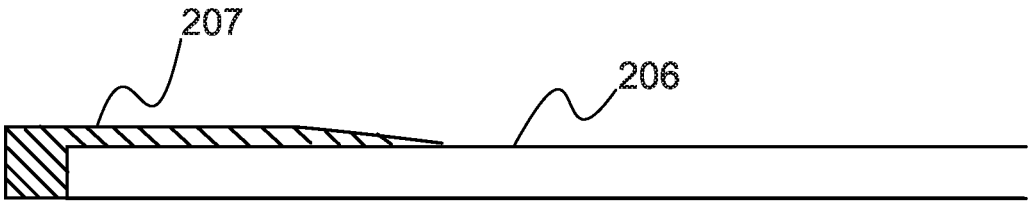
Figure 2D:
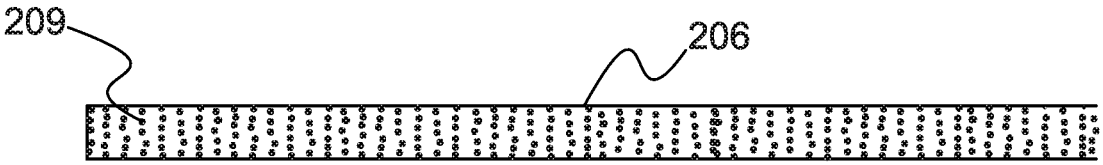
Figure 2E:
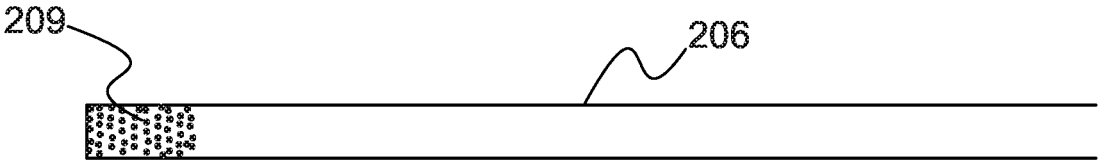
Figure 2F:
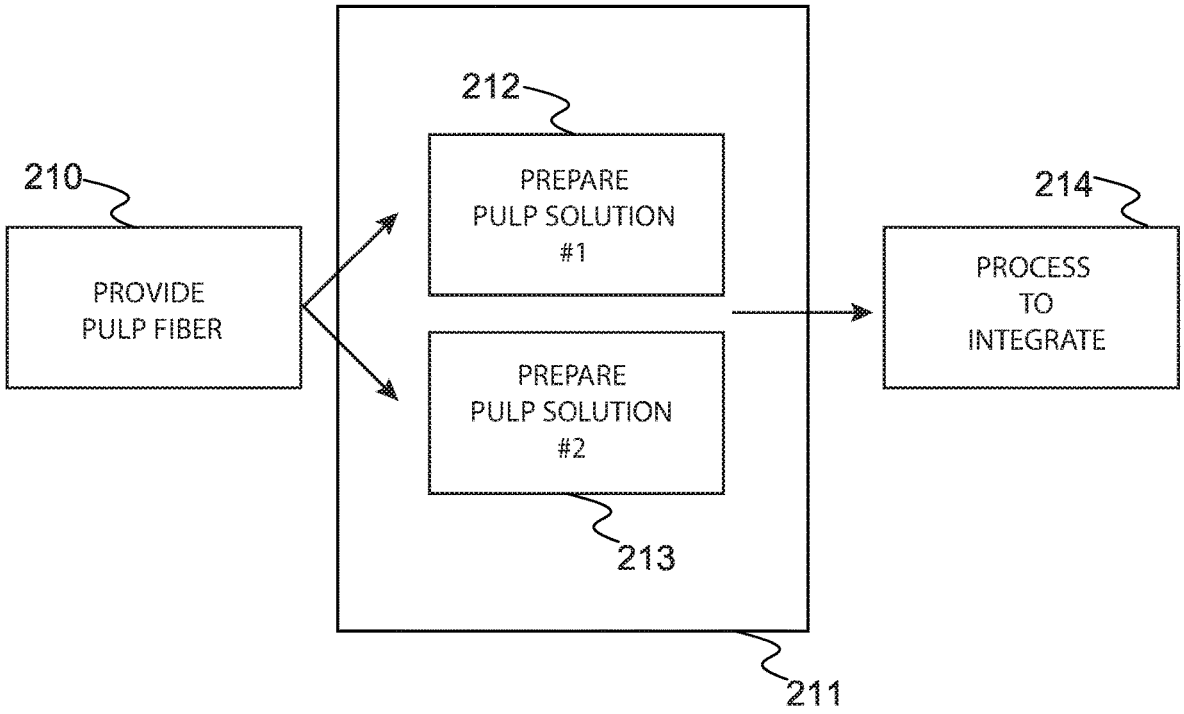

Turning now to the figures, FIG. 1(*a*) and FIG. 1(*b*) depict an example of a magnetically bound medium, namely a book, comprising a magnetic binding and one or more magnetically reattachable pages, in accordance with an exemplary embodiment of the present invention. Specifically, FIG. 1(*a*) and FIG. 1(*b*) depicts bound book (book 100). Book 100 comprises front cover 101; back cover 102; magnetic binding 103, which includes spine 104, magnet 108, and magnet cover 105; and multiple pages, such as page 106, each page comprising adhered component 107.

Front cover 101 is typically the top-most part of book 100 when it is closed and facing right-side up. In this case, front cover 101 rests adjacent to the bound media's first page. Front cover 101 may be any type of protective covering that is typically utilized to bind together the pages of a journal, notebook, novel, or more generally a book. Front cover 101 may be constructed in any familiar fashion without deviating from the scope of the present invention. For example, front cover 101 may be a hard cover, a soft cover, and may include any other feature such as dust jackets, or any other type of protective means typical of traditional types of book-bindings and covers.

Similarly, back cover 102 is typically the bottom-most part of book 100 when it is closed and facing right-side up. Back cover 102 rests adjacent to the bound medium's last page. Therefore, when closed, book 100 has front cover 101 on top and back cover 102 on bottom. As with front cover 101, back cover 102 may also comprise the typical cover designs known in the art without deviating from the scope of the present invention.

Magnetic binding 103 serves as the binding for book 100 and may be an alternative to traditional adhesive and sewn bindings, as well as ringed bindings. Magnetic binding 103 extends from the bottom of book 100 to the top, running along the length of spine 104. Magnetic binding 103 comprises spine 104, which supports a magnetic component such as magnet 108, and magnet cover 105 for enclosing the magnetic component. Additionally, magnetic binding 103 enables the magnetic binding and disjoining of the reattachable pages that make up the bound medium.

Spine 104 is a support structure that links front and back covers 101, 102 together on the binding side and supports a magnet housed within magnetic binding 103. Spine 104 runs substantially perpendicular to the pages shown. Spine 104 may be constructed in any known manner without deviating from the scope of the present invention. For example, if the covers of a desired book in accordance with the present invention are hard covers, it may be desirable to implement a hard spine. Similarly, paper backs, or soft covers may be implemented, in which case a softer spine may be utilized. Importantly, it is the implementation of the magnetic component, which spine 104 supports or houses, that enables the reattachment of the plurality of pages. Hence, spine 104 should be constructed of any material that is suitable for allowing magnetic binding 103 to properly support and house the magnetic component—in the present embodiment, magnet 108.

It should also be noted that while bound media such as more traditional books and notebooks may implement a spine, spine 104 is not required in alternative embodiments of the present invention. Nevertheless, implementing spine 104 with magnetic binding 103 may be desirable for both structural support and aesthetic purposes.

As stated above, magnetic binding 103 houses a magnetic component. This magnetic component may be any type of magnet suitable for retaining a plurality of pages within the bound media. Hence, the magnetic component may comprise of one or more permanent magnets or a single magnet, or a wide variety of types of magnets without limiting or deviating from the scope of the present invention. In an exemplary embodiment, magnetic binding houses a permanent magnet such as magnet 108.

Magnet 108 may typically comprise of a diametric magnet, but as stated above other magnets may be incorporated as well. In the presently depicted embodiment, magnetic binding 103 is diametrically magnetized, meaning the magnet's north and south poles are split along its diameter. While this feature of the magnet is not meant to limit the scope of the present invention, diametric magnets are desirable because they allow use of a shape that is compatible with the well-known structure of bound mediums such as books, notebooks, journals and the like.

Magnet 108 has a cylindrical shape, although other shapes may be used as well without deviating from the scope of the present invention. While non-circular shapes will not have a diameter, it is still possible to diametrically magnetize these magnet shapes by separating the polarities along where the diameter would be if the shape were circular in nature. Such non-circular shapes as well as non-cylindrical circular or spherical shapes exist as alternative embodiments of the present invention. Furthermore, in alternative embodiments, magnet 108 may be axially magnetized, meaning the north and south poles of the magnet are separated along a shape's height rather than its diameter.

Magnet 108 may be held within magnetic binding 103 in any known manner without deviating from the scope of the present invention. Magnet 108 may be held by an adhesive, or a cloth that may be sown into spine 104, or may be held together by clasps, or any other means of holding and securely maintaining magnet 108 in a stable and suitable position. In one embodiment, shown in FIG. 1(*b*), magnet 108 is secured in place by sandwiching the magnet between spine 104 and magnet cover 105.

Magnet cover 105 holds magnet 108 in place against spine 104. Together with spine 104 and back cover 102, magnet cover 105 forms an enclosure to secure magnet 108 within magnetic binding 103 and prevent the magnetic component from being displaced. This enclosure extends parallel to back cover 102 initially then contours to the shape of magnetic binding 103 thereafter.

A plurality of specialized pages that are adapted to magnetically bind with magnetic binding 103, may be positioned in any order within book 100. These pages may be attached, removed, and reattached as mentioned above. Page 106, is an exemplary embodiment of one of these pages in accordance with the present invention.

Page 106 may be any page type, such as but not limited to, a standard printing page or photo album page. Page 106 may be any type of page suitable for the desired type of bound medium. For example, and without limiting the scope of the present invention, in an embodiment in which book 100 is a drawing book, page 106 may be a blank drafting page suitable for drawing. In another embodiment, in which book 100 is a notebook, page 106 may be a lined page, suitable for making notes or keeping written records. Alternatively, page 106 may be any type of page and may comprise graphing paper, lined paper, or blank pages made of drafting paper. Similarly, the thickness and type of paper used may be any type known in the industry so long as the type of paper may be adapted with an adhered component for magnetically binding the page to magnetic binding 103. Therefore, page 106 typically comprises adhered component 107.

Adhered component 107 may be a single component or multiple components, so long as it comprises a magnetizable material that will enable page 106 to magnetically bid with magnet 108 of magnetic binding 103. Thus, adhered component 107 may comprise one or more substances suitable for magnetization. For example, and without limiting or deviating from the scope of the present invention, adhered component 107 may be a magnetizable powdered material, for instance, a metal powder, applied to an adhesive to adhere it to page 106. Alternatively, adhered component may be a metal strip constructed of thin metallic materials which will magnetically bind to a magnetic source. By way of a non-limiting example, a metallic strip which is either adhesive or non-adhesive may be used.

In an exemplary embodiment, the magnetizable material of adhered component 107 is iron powder or resin, though any number of metals may be used in its stead. Furthermore, the adhesive component of adhered component 107 may be any standard adhesive used on metallic powder that would be known by a person of ordinary skill in the art.

Adhered component 107 may be on any part of a page and employ a wide variety of dimensions. In an exemplary embodiment, adhered component 107 runs parallel to magnetic binding 103 and possesses a width of less than one tenth of an inch. In another embodiment, adhered component 107 possesses a width of one sixteenth of an inch so that only a small portion of page 106 is utilized for purposes making page 106 reattachable to magnetic binding 103.

Page 106 is just one of many pages magnetically bound in book 100. In the present embodiment, pages will not perfectly overlay one another due to the dynamic width of the cylindrical magnet to which said pages are magnetically attracted. However, in other embodiments, other shapes in lieu of a cylindrical magnet may be used that allow for pages to perfectly overlay one another. For instance, a substantially flat shape such as a flat rectangular prism may be implemented so that the width of the prism is consistent throughout its height. Thus, with a given media, for instance book 100, pages would be substantially perpendicular to the height of the magnetic binding.

Turning now to the next figures, FIG. 2(*a*) depicts another example of a magnetically bound medium, in accordance with another exemplary embodiment of the present invention. Specifically, the bound medium in FIG. 2(*a*) is a notebook or notebook 200. Notebook 200 comprises front cover 201, back cover 202, and magnetic binding 203, which includes spine 204, magnet 208, and binding clasp 205. Additionally, page 206 may be one of a plurality of pages contained in notebook 200, page 206 comprising adhered component 207.

In the present exemplary embodiment, magnetic binding 203 includes a substantially cylindrical magnet 208, diametrically magnetized with a length approximately equal to that of spine 204 or adhered component 207. While magnet 208 is shown substantially cylindrical, alternative embodiments may exist without deviating from the scope of the present invention. For instance, the magnet used for a binding may employ other shapes such as, but not limited to, a triangular shape, a rectangular shape, an arc or half cylinder shape, a concave cylindrical shape, a disc shape, a block, a ring, or spherical shapes, without limiting the scope of the present invention. These shapes may be prismatic or non-prismatic, or comprise of any other shape that is suitable for creating a binding for a book, notebook, journal or the like.

In an exemplary embodiment, magnet 208 is a permanent neodymium alloy magnet that includes neodymium, iron, and boron. Furthermore, in this exemplary embodiment, the neodymium alloy may be coated with a conductive metal such as nickel or copper, though other conductive metals may also be employed in addition to or in lieu of nickel and copper. For instance, the alloy may be coated with epoxy, zinc, gold, silver, tin, or parylene. Alternatively, the alloy may remain uncoated. However, coating the neodymium alloy with a conductive metal may be desirable as this affords corrosion resistance as well as an aesthetically pleasing, shiny finish. In another embodiment, magnet 208 is a permanent samarium alloy magnet comprising samarium and cobalt, which may also utilize the same or different coating materials as the neodymium alloy.

Binding clasp 205 secures magnet 208 through several restraints tightly fitted against spine 204 of magnetic binding 203. Binding clasp 205 refers to the entire set of clasps illustrated in FIG. 2(*a*). Binding clasp 205 may be mechanically or adhesively secured into a combination of front cover 201, back cover 202, and spine 204 and may be made of a myriad of materials that would be known or easily ascertainable for a person of ordinary skill in the art.

Page 206 may be any page that would be present in any written or pictorial medium. As depicted in FIG. 2(*a*), page 206 is disengaged from magnetic binding 203. Such disengagement is possible by a user of notebook 200 applying a deliberate counterforce greater than the attractive magnetic force of magnetic binding 203. This magnetic force is effective on page 206 due to adhered component 207, whereby the magnetizable material present in adhered component 207 is magnetically attracted to magnet 208 of magnetic binding 203. If desired, page 206 may immediately be reintegrated into notebook 200 in any order by placing adhered component 207 of page 206 in close proximity to magnetic binding 203.

Removal and reintegration of pages in accordance with the present invention is nearly instantaneous and effortless, as opposed to removing and reintegrating pages in a ringed binder, which comparatively requires considerably more time and effort. Additionally, and with continued reference to ringed binders, the present invention does not require bulky rings to accompany it, thereby decreasing the minimum size of a binder to that of the magnet in magnetic binding 203 and not of the large rings seen in traditional ringed binders.

Spiral notebooks are a variation of a ringed binder wherein the spirals do not open, and pages are held in place through an abundance of tiny holes present where the spirals make contact with the page. Such notebooks allow for removal of pages through either removing the entire page including the now-torn tiny holes or by disengaging the page from the rings along a perforated line, wherein the section with tiny holes remains within the notebook.

In any case, after tearing out a page from a spiral notebook, the user has a number of issues to address. First, the frilled interior is unsightly and may get caught on other pages. Or, if the frilled interior was separated from the page along the perforated line, it takes up unnecessary space in the notebook. Thus, the user is presented with a secondary task upon removing a paper, a task that is eliminated by the discussed magnetically bound media. Second, any user of ringed binders, including spiral notebooks, has encountered the frustration of having their writing hand impeded by the rings. For instance, a right-handed individual writing on a left side page or a left-handed individual writing on a right-side page frequently bumps into the rings and is forced to write in an unnatural configuration, consequently inhibiting legible penmanship. Due to the strong magnetic attraction present between the exemplary neodymium alloy magnet and adhered component of the present invention, magnetic binding 203 can be considerably smaller than traditional spirals and rings and thus mitigate penmanship woes. Additionally, a user may simply remove a page from the magnetically bound media, write on the isolated, unbound page, and reintegrate it at a later time to completely eliminate the aforementioned problem with writing in an unnatural configuration.

To bind adhered component 207 to page 206, in an exemplary embodiment, application of an adhesive may be carried out using a single coat applied to both sides of a page along any edge. In another exemplary embodiment, conductive metal may be added onto the adhesive at a substantially fixed ratio. By way of a non-limiting example, a mixture may be created in which about 325 grams of magnetizable material may be added to an adhesive for approximately every eight ounces of adhesive paint, which is exemplarily acrylic, though other materials may also be used without deviating from the spirit or scope of the present invention. This typically results in one or two grams of magnetizable material on each sheet created. Regardless, the adhesive may be applied using any number of methods, including but not limited to, serigraphy, printing, air spraying, brushing, or brayer rolling. Of course, other methods could be used, including taping a magnetic component to page 206, or integrating a magnetic component right into the pulp material used for constructing page 206. Various methods of implementing adhered component 207 or a similar magnetic component, into page 206 are discussed in turn.

The following figures help to illustrate two methods or manners in which adhered component 207 may be implemented with page 206. FIG. 2(*b*) depicts a close-up perspective view of a page that has been adapted with an adhered component that comprises a magnetic strip, which has been adhered to the inner edge of the page, in accordance with an exemplary embodiment of the present invention. And FIG. 2(*c*) depicts a close-up side view of a page that has been adapted with another type of adhered component in accordance with another exemplary embodiment of the present invention.

FIG. 2(*b*) depicts a portion of page 206, which in an exemplary embodiment comprises adhered component 207 that includes a magnetic strip adhered to the inner edge of the page. Adhered component 207 may be adhered to page 206 using known methods, the exact means of which would be apparent to a person of ordinary skill in the art. In the present embodiment, adhered component 207 does not utilize a powder or resin to render it magnetizable to magnetic binding 204. Adhered component 207 may or may not make use of an adhesive material in addition to a mechanical means to be secured to page 206.

FIG. 2(*c*) depicts a magnified side view of another embodiment of the page from FIGS. 2(*a*) and 2(*b*), whereby only the width of the page is visible and in which the adhered component hangs over the edge of the page. There may be times when a stronger magnetic attraction between magnetic binding 203 and adhered component 207 is desired. Thus, in the present exemplary embodiment, a slight lip or overhang is created by adhered component 207 so that magnetizable material exists not only on the inside of page 206, but also along its minute width. This permits the magnetizable material to more directly attach to a magnetic binding. In the present figure, a magnetic strip is not used. Instead, a resin, powder, or other similar item may be added to an adhesive material, forming adhered component 207.

FIG. 2(*d*) depicts a close-up side view of page 206, which has been infused with magnetic component 210. The magnetic component may be integrated with the material from which the page is made, in accordance with another exemplary embodiment of the present invention. Similarly, FIG. 2(*e*) depicts a close-up side view of page 206, a portion of which has been infused with magnetic component 210. Thus, in these embodiments of the present invention, rather than applying an adhesive with a magnetic component on top of the sheet, or adding a magnetic strip to the page, a magnetic component, such as a magnetic powder (e.g.

containing iron, neodymium) may be integrated into the pulp of the material typically utilized in paper making methods.

For example, and without deviating from the scope of the present invention, When processing the pulp typically used to make a sheet of paper, a magnetic component may be added to this pulp in order to integrate the magnetic component into each sheet. In this manner, the integrated component doesn't have to go through another process or machine to apply the conductive metal, because the metal is applied at the same time when the paper is turned from fibered pulp to a freshly made sheet. This method may be desirable because it offers an inexpensive and cost-effective means of production. Furthermore, integrating magnetic component 210 into each sheet does not create an additional rising to the surface of paper 206, which allows for more pages to fit or connect to magnetic binding 203.

A pulp fiber may include any known pulp fiber or pulp solution typically utilized for making paper. Pulp fiber may comprise, without limiting or deviating from the scope of the present invention, a first portion of organic materials and a second portion of inorganic materials, both portions mixed with a third portion of a magnetic component that includes a conductive powder as described above. Furthermore, the organic portion may include cellulose, hemicelluloses, and lignin; while the inorganic portion may include calcium carbonate, clay, and titanium oxide. Of course, other known ingredients may be incorporated with a pulp fiber mixture without limiting or deviating from the scope of the present invention.

While the embodiment shown in FIG. 2(*e*) includes only a portion of page 206 infused with magnetic component 210, FIG. 2(*d*) shows an embodiment in which the entire sheet or page 206 is infused with magnetic component 210. In other embodiments, magnetic component 210 may be integrated throughout a border of page 210. Such alternative configurations may be desirable to, for example, create a magnetic edge throughout the entire perimeter of page 206 so that paper may be magnetically attached to magnetic binding 203 on any side or edge. In embodiments in which an entirety of page 206 is infused with magnetic component 210, even if page 206 is cut into any shape, page 206 may still be magnetically attached to magnetic binding 203 by any edge.

Embodiments that implement magnetic component 210, infused or integrated with the sheet material, may be utilized with any type of sheet material without deviating from the scope of the present invention. For example, page 206 may comprise of book paper, business form paper, carbon base paper, carbon paper, coated paper, copier paper, cream wove paper, defense craft paper (i.e. laminates), diary paper, fax base paper, fluorescent paper, general writing paper (i.e. note book paper), greaseproof paper, label paper, laser paper, newsprint, vinyl paper, onion paper (i.e. transparency paper), or any other type of paper type or paper material known in the art.

FIG. 2(*f*) is a flowchart of a method for making a page for a magnetically bound medium, in accordance with practice of one embodiment of the present invention. The method is shown in the following steps, however, it is understood that the process may be achieved in any other conceivable sequence without deviating from the scope of the present invention.

In step 210, any known method of creating, or obtaining pulp fiber may be employed; pulp fiber may include any type of pulp fiber commonly used for making paper type materials. For example, and without deviating from the scope of the present invention, pulp fibers may be obtained via a wood free process. Typically, after selecting a type of wood, it is cooked in an acidic solution in order to dissolve the lignin and separate the plant fibers. The selected wood may comprise a single type of wood, or several types—for example, the wood sawed may comprise one or more of the following types of wood: Birch, Poplar, Beech, Eucalyptus, Spruce, Fir, and Pine. In one embodiment, Spruce is the main source of wood as it is typically the strongest for producing strong quality paper sheets. Furthermore, processing or providing paper pulp may include whitening the fiber, washing or processing with chemicals such as bleach using oxygen and peroxide. After this step is complete, the treated pulp may be dried, baled.

In step 211, a pulp solution may be prepared, which includes a conductive or magnetizable component. Generally, preparing the solution allows for the paper fiber to disperse evenly, reducing any uneven densities and thicknesses in unwanted areas. Also, this may provide a desirable opportunity for last minute refining. Thus, in accordance with the present invention, step 211 may comprise of a single step, or of multiple steps in which one or more solutions are prepared in order to create a magnetizable sheet of paper. For example, and without limiting the scope of the present invention, the solution making process may comprise of step 212 in which a single solution is created, or may further comprise of step 213, in which an additional solution is created in order to combine the solutions of step 212 and step 213 and integrate them to form the magnetizable sheets of paper.

In order to create the paper that maximizes the functionality for the magnetic medium, two different pulp solutions may be required; however, this may depend on the cost or even the amount of conductive metal used in making each sheet of paper. That is, in embodiments in which each sheet of paper is fully infused with a conductive metal powder, then only one pulp solution may be required and step 212 may be skipped, as step 212 comprises of a solution that contains no magnetizable or conductive component integrated with the pulp fibers.

However, in other embodiments, only a section of each sheet of paper may contain a conductive metal or magnetizable component. In such embodiments, for example wherein a strip along the edge of each page is utilized to connect the page to the cover of the book, two solutions may be required and hence both steps 212 and 213 may be exercised.

In step 212, the pulp fibers are mixed with water to become pulp solution. This solution is then refined by passing through a known process for making the paper stronger. Wood fibers alone produce rough texted & unevenly dense paper, and fillers such as calcium carbonate and clay may be mixed in to make the paper more opaque and give the paper more controlled thickness and density. Dyes, and other known materials may be implemented into the pulp to improve the appearance of the paper. The pulp solution resulting from step 212 is typically a controlled mix of fibers, fillers and coloring agents suspended in water. As stated above, this solution is to be integrated with a second solution discussed with reference to step 213, in accordance with practice of one embodiment of the present invention.

In step 213, a solution is created in which an added component such as a conductive or magnetizable powder is mixed with typical pulp solution, such as a solution similar to that discussed in step 212. In one embodiment, a highly powderized metal is used, which comprises a −325 mesh or lower of any conductive or magnetizable ingredients, so that the powder's particle size is approximately less than 44 micrometers. Of course, other particle sizes may be implemented without deviating from the scope of the present invention.

In step 214, in embodiments wherein each sheet of paper or page comprise of the magnetic component integrated throughout the entire page, only the pulp solution created in step 213 is utilized and finally processed with known methods to create the magnetizable sheets.

In embodiments in which only a portion of each page comprise a magnetizable component, for example one or more edges of each page, then both solutions of step 212 and step 213 are brought together and pressed through rollers that combine both solutions in the desired configuration. For example, the solutions may be brought together so that only a top portion of each page comprises the magnetizable component. In step 214, typically, a system of rollers is used to press the pulp solutions into the desired sheets, which are then dried to form sheet rolls that contain the magnetizable component integrated into the paper.

Figure 3:
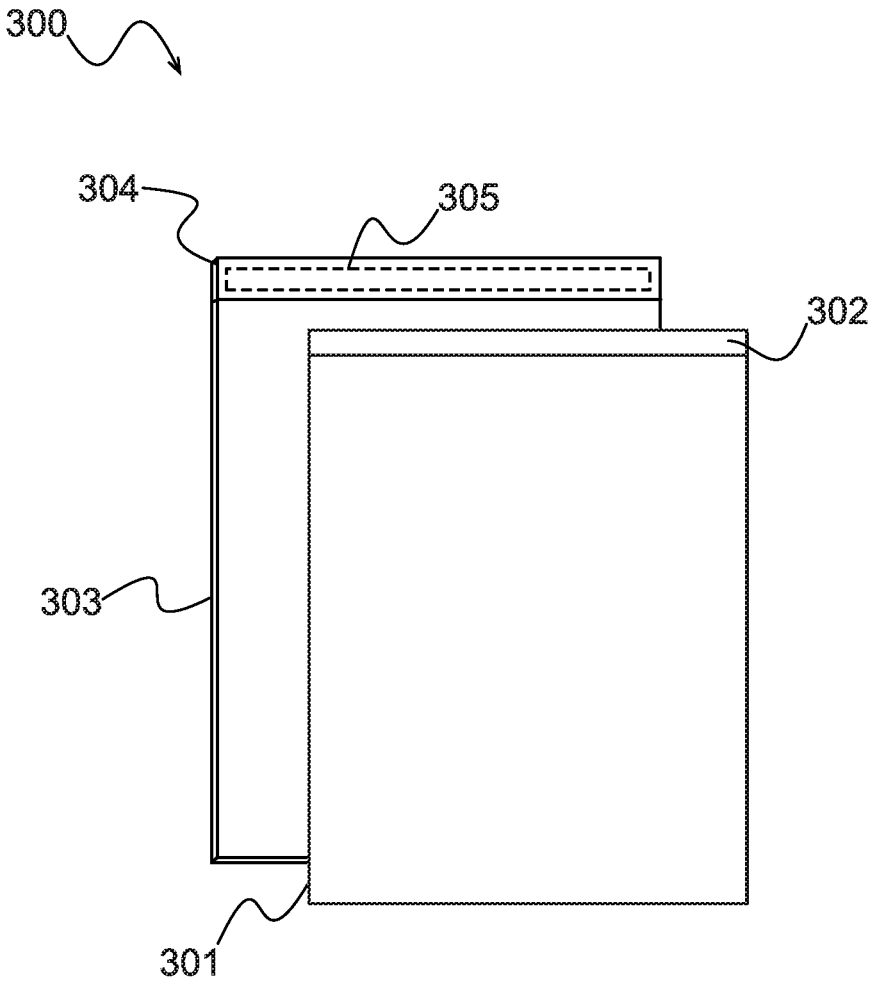
FIG. 3 depicts a page offset from a magnetically bound notepad, the page comprising an adhered component that includes a magnetizable material for binding with the magnetically bound notepad, in accordance with an exemplary embodiment of the present invention.

FIG. 3 depicts a page offset from a magnetically bound notepad, the page comprising an adhered component that includes a magnetizable material for binding with the magnetically bound notepad, in accordance with an exemplary embodiment of the present invention. Notepad 300 is illustrated, comprising page 301, adhered component 302, support structure 303, and magnetic binding 304, which includes magnet 305.

With respect to the present figure, page 301 is one which might be found on a notepad, such as a legal pad or sketch pad. Thus, adhered component 302 is located atop the page on its shorter side where binding traditionally resides in such pads.

Traditional notepads have bindings atop the pad attached to each page, wherein the bound parts of each page remain in the pad even after the rest of the page becomes disengaged. Disengagement occurs at the perforated line spanning across the pad at the bottom of the binding. Such pads mitigate some of the presented problems with current written and pictorial media, such as the space taken up by ringed bingers, but still cannot address the issue of reintegrating the page into the binding once disengaged. Certainly, a user can lodge the page back into the pad and hope that the friction is sufficient to keep it in place, though this technique may lead to pages unexpectedly falling out of the notebook or slipping and being folded or crumpled beneath the weight of the pad. However, the illustrated exemplary embodiment of the present invention alleviates this concern, as demonstrated in the discussion of notepad 300.

Support structure 303 supports the pages of which page 301 will be atop of once it is reintegrated into notepad 300. Furthermore, support structure 303 may provide support for securing magnet 305 and holding it in place at the top of the notepad. Support structure 303 may be constructed of any known and commonly used materials typically used in notepads to provide support for the notepad and to provide a place for the user to support the notepad's pages when writing or drawing on the notepad. Without limiting the scope of the present invention, support structure 303 may be constructed of cardboard, plastics, metals, or any other material suitable for adding structural support to notepad 300. Each of the notepad' s pages, including page 301, are kept in place in much the same way as is discussed in FIGS. 1-2, with aid from a magnetic source such as a permanent magnet.

Magnetic binding 304 serves as the simple alternative to the binding present in current notepads. Rather than employ a dense binding of the top portions of each page, the present exemplary embodiment allows the top of each page, for example page 301, to be magnetically attracted to magnetic binding 304 through the magnetic force of magnet 305. Thus, the top of page 301 will be removable and reattachable from notepad 300. As mentioned above, the magnetic binding in this embodiment may too have a cover, either for structural purposes or for aesthetic purposes, or both. As shown, magnetic binding 304 houses magnet 305 within. Naturally, the material from which such a cover is made should be a material that does not interfere with the magnetic properties of the magnetized binding or magnet 305.

Figure 4:
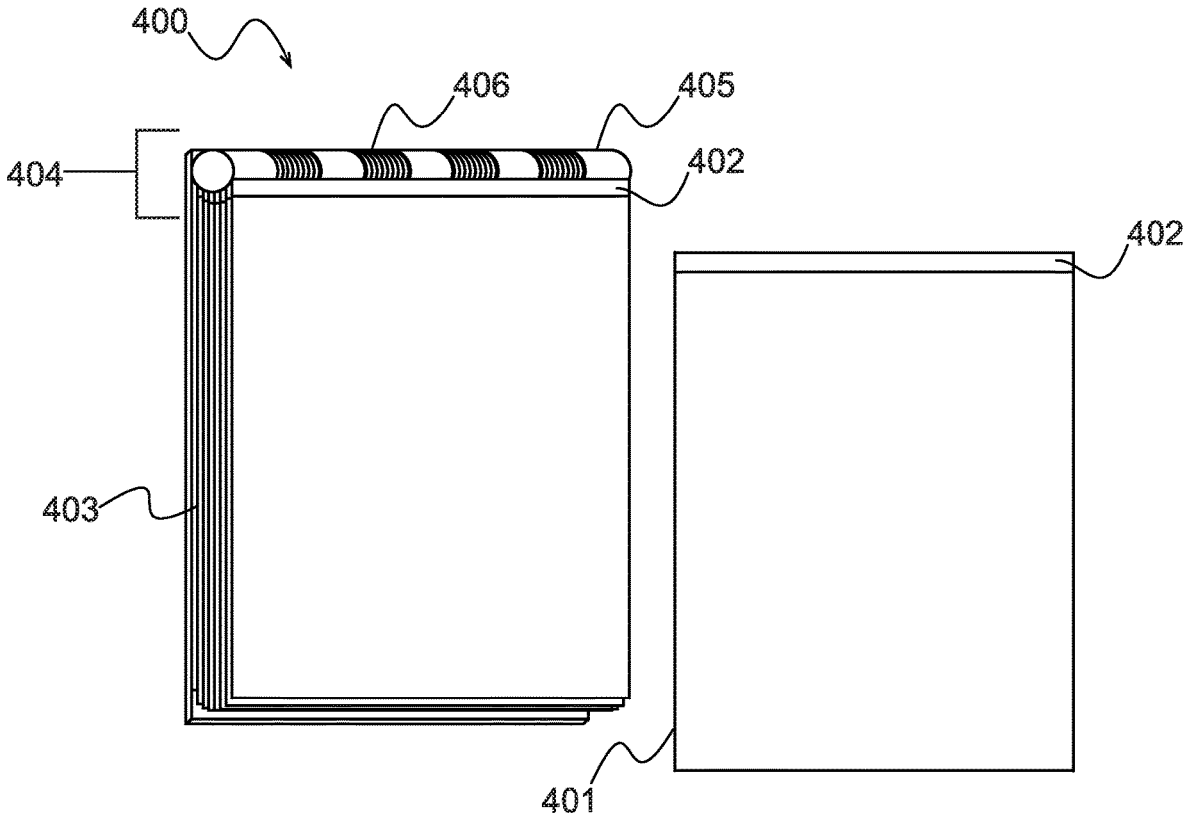
FIG. 4 depicts a page offset from a magnetically bound notepad, the page comprising an adhered component that includes a magnetizable material for binding with the magnetically bound notepad, in accordance with another exemplary embodiment of the present invention.
Figure 5A:
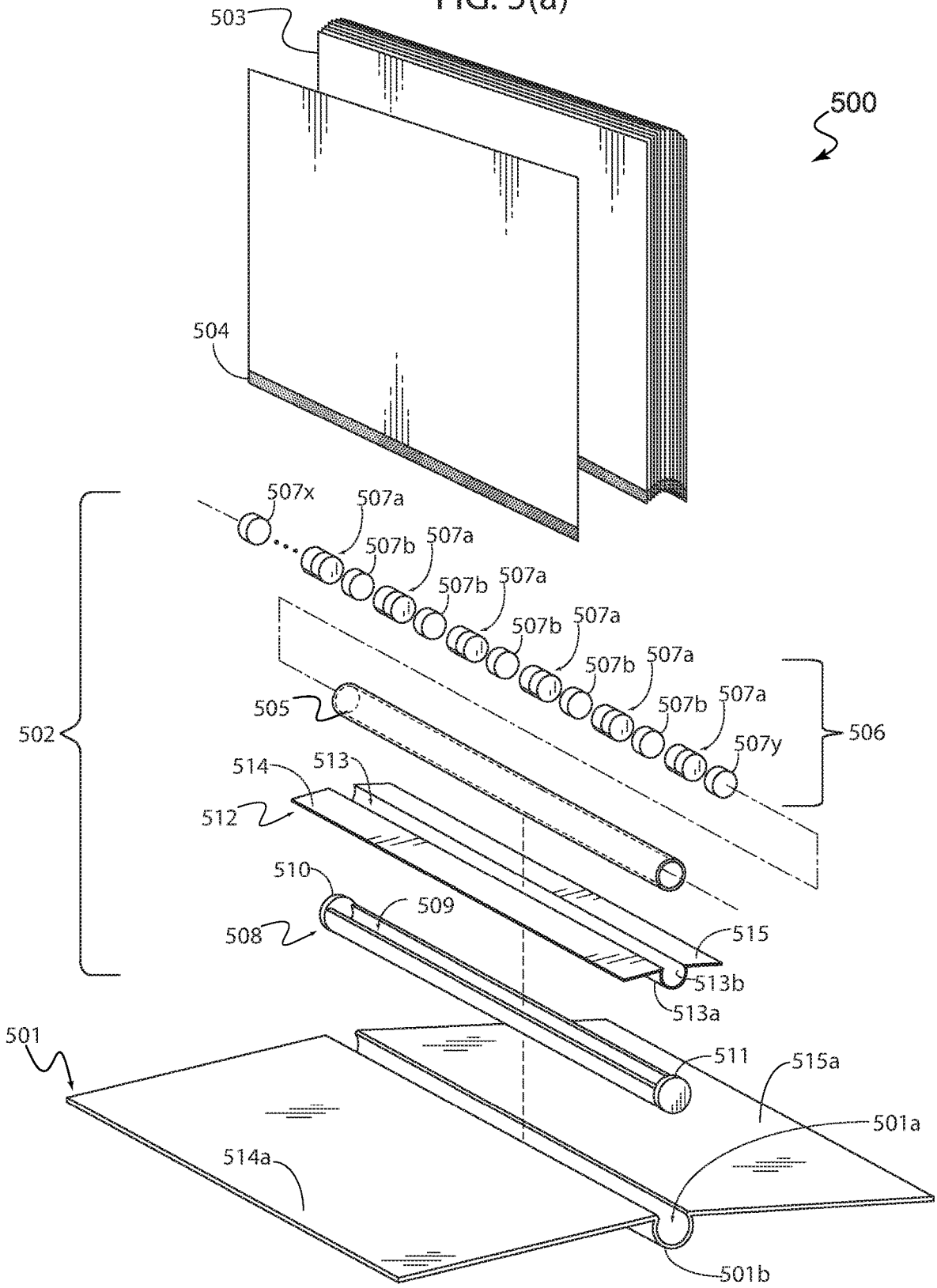
FIG. 5(*a*) depicts an exploded view of a magnetic notebook in accordance with an exemplary embodiment of the present invention.
Figure 5B:
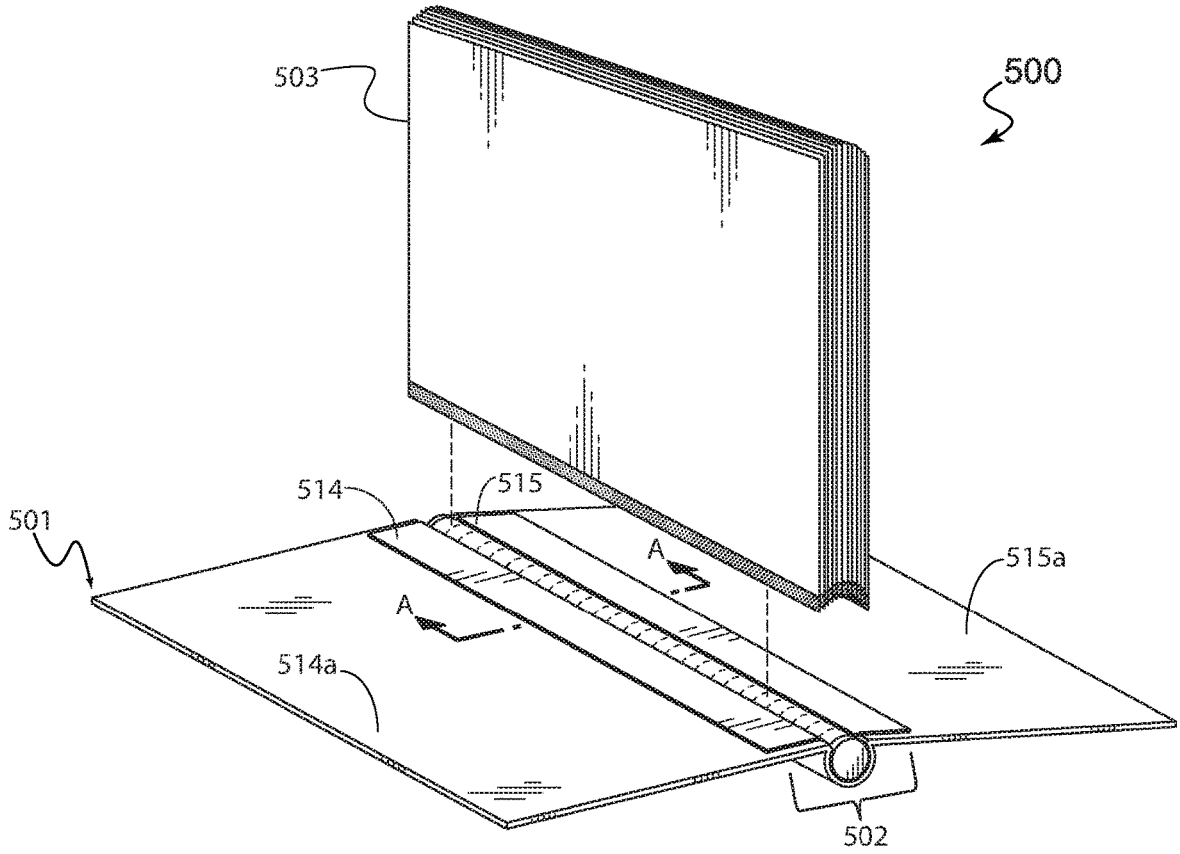
Figure 5C:
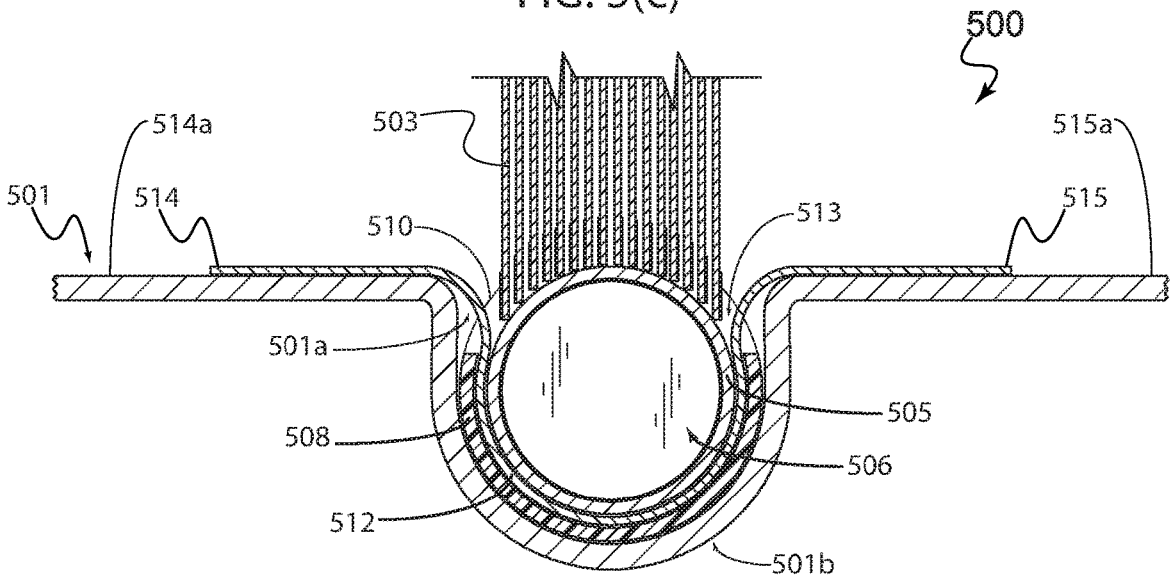
Figure 5D:
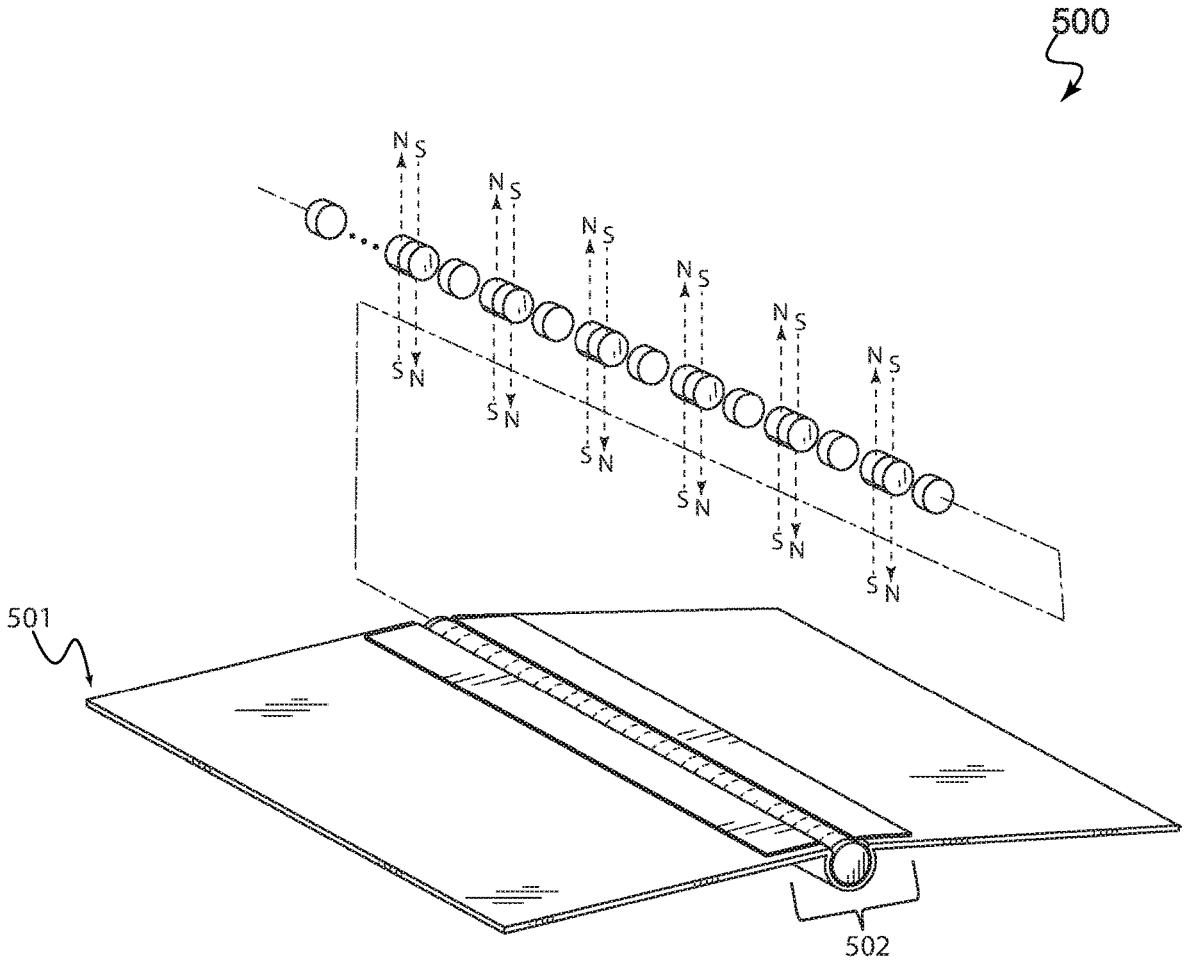

FIG. 4 depicts yet another embodiment of the present invention. This embodiment is but one of many variations, and works in the same manner as the embodiments discussed above. Notepad 400 is illustrated, comprising page 401, adhered component 402, support structure 403 for supporting a plurality of pages (shown but not numbered), and magnetic binding 404, which includes magnet 405. In this embodiment, magnet 405 is a diametric magnet that is cylindrical in shape, and has been secured to the notepad's support structure utilizing clasps 406. As with the other embodiments herein, notepad 400 provides users with the ease of attaching and removing pages from the notepad without ripping or damaging each page.

Turning now to the next set of figures, FIG. 5(*a*) depicts an exploded view of a magnetic notebook in accordance with an exemplary embodiment of the present invention. More specifically, FIG. 5(*a*) depicts an exploded view of magnetic notebook 500, which in accordance with an exemplary embodiment comprises a cover 501, a magnetic assembly 502, and a plurality of reattachable sheets of paper (pages 503), each of the reattachable sheets of paper including a magnetizable or metallic component 504 configured to magnetically register with a surface of magnetic tube assembly 502.

Cover 501 of magnetic notebook 500 may be constructed in any familiar fashion as known notebooks without deviating from the scope of the present invention. For example, cover 501 may be a hard cover, a soft cover, and may include any other feature such as dust jackets, or any other type of protective means typical of traditional types of notebook covers. However, cover 501 includes a channel 501*a* that may typically run along a length of spine 501*b* of cover 501. Channel 501*a* may comprise an elongated curved shape such as a concaved or cylindrical shape, a rectangular shape, or any shape without deviating from the scope of the present invention. In exemplary embodiments, channel 501*a* of cover 501 has a substantially cylindrical shape such that a cylindrical structure may easily register or engage with channel 501*a*; a cylindrical shape may be desirable to house a cylindrical structure such as a cylindrical magnet or a magnetized cylindrical structure as will be discussed further below.

Magnetic assembly 502 may include several components; without limiting the scope of the present invention, magnetic assembly 502 may include an enclosure 505, a diametrically magnetized cylinder 506 including a plurality of magnets 507*a* and spacers 507*b* that may be housed within enclosure 505, a spine clamp 508 configured to engage with channel 501*a* of cover 501 and including an opening 509 and end-caps 510, 511 for snuggly receiving and securing enclosure 505 therein. Sandwiched between enclosure 505 and spine clamp 508—in contact with the outer walls (or in the shown embodiment tubular body) of enclosure 505 and the side walls forming opening 509 on spine clamp 508—a hinge mount 512 may be implemented for added support of magnetic assembly 502. Hinge mount 512 includes a cavity 513 for receiving enclosure 505 and planar supports 514, 515 adjacent and extending from a top surface of cavity 513, which may be adhered to a portion of cover 501 when fully assembled.

As mentioned above, each of pages 503 includes a magnetizable material or a metallic component 504 configured to magnetically register with a surface of magnetic tube assembly 502. In one exemplary embodiment, metallic component 504 comprises a metallic strip. In another exemplary embodiment, metallic component 504 comprises a magnetizable powder that is integrated onto the one or more reattachable pages using an adhesive, wherein the magnetizable powder may include, for example and without limiting the scope of the present invention, iron and nickel.

Enclosure 505 may comprise a variety of shapes and may be constructed from various materials without deviating from the scope of the present invention. In one exemplary embodiment, enclosure 505 is a tubular enclosure formed of a thin foil. In another exemplary embodiment, enclosure 505 is a tubular enclosure formed of a thin paper tube. In yet another exemplary embodiment, enclosure 505 is a thin steel tube. In yet another exemplary embodiment, enclosure 505 comprises tape wrapped in a tubular manner to surround diametrically magnetized cylinder 506. In yet other embodiments, enclosure 505 has a rectangular shape or other uniform or non-uniform shapes; notably, it may be desirable that enclosure 505 comprise a shape substantially similar to or matching the shape of other registering components of magnetic assembly 502 such as spine clamp 508 and or channel 501*a* and spine 501*b* of cover 501.

Accordingly, in an exemplary embodiment, enclosure 505 is a tubular enclosure constructed of a paper material forming a tube suitable for registering within cavity 513 of hinge mount 512, wherein cavity 513 includes a substantially cylindrical shape as illustrated in FIG. 5(*a*), and which is configured to receive diametrically magnetized cylinder 506 within the paper tube. A tubular enclosure in accordance with an exemplary embodiment of the present invention may comprise a stainless-steel tube that snuggly receives a diametrically magnetized cylinder therein. In some embodiments, the tubular enclosure is constructed merely of a tubular tape enclosure that houses, surrounds or envelopes the diametrically magnetized cylinder. In other embodiments, the tubular enclosure is constructed of foil, paper, plastic, vinyl, fiber-glass, or any other suitable material that houses, surrounds or envelopes the diametrically magnetized cylinder. However, it should be noted that whatever the construction or material of the tubular enclosure, it should not interfere so much with the magnetic field of the magnetized cylinder such that the magnetic sheets of paper fail to attract to the magnetic component.

Diametrically magnetized cylinder 506 may comprise a plurality of components (as shown in FIG. 5(*a*)) or simply a single magnet as disclosed above with reference to other exemplary embodiments. However, in the shown embodiment, diametrically magnetized cylinder 506 comprises of a plurality of magnets 507*a* and spacers 507*b* suitable for being housed within enclosure 505. In exemplary embodiments of the present invention, a diametrically magnetized cylinder may comprise a plurality of diametrically cylinder magnets (for example, and without limiting the scope of the present invention, pure earth magnets) containing one or more plastic cylinder spacers (or spacers constructed of other materials) in-between the one or more of magnets. The magnets and spacers may be held together, wrapped or placed within an enclosure such as enclosure 505. In some embodiments, in addition to or in lieu of implementing enclosure 505, the plurality of magnets 507*a* and spacers 507*b* may be simply wrapped up with one or more materials such as tape, thin metal, foil, paper, vinyl, fiber glass, or other materials suitable for containing the plurality of magnets 507*a* and spacers 507*b* together.

Whatever the construction of diametrically magnetized cylinder 506, the overall structure that holds the magnets or magnetic element should not interfere with an adequate magnetic attraction between diametrically magnetized cylinder 506 and pages 503. Moreover, the plurality of magnets 507*a* and spacers 507*b* may be arranged in any manner and or sequence that furthers a desirable magnetic adherence or attracting force between diametrically magnetized cylinder 506 and pages 503. For example, and without limiting the scope of the present invention, in one exemplary embodiment (as shown in FIG. 5(*a*)) diametrically magnetized cylinder 506 may include a plurality of spacers 507*b* in-between a plurality of diametrically magnetized magnets, wherein each of the plurality of spacers 507*b* is positioned between a pair of diametrically magnetized magnets 507*a* having complimentary polarity. Although each of the plurality of magnets 507*a* is shown as a disk or cylinder, other similar shapes may be suitable such as rings or even blocks. Disks or cylinders as shown for magnets 507*b* may be desirable because this shape is particularly useful in maximizing a magnetized surface area for pages 503 to couple to when attached to magnetic notebook 500.

In such embodiment, spacers 507*b* may comprise cylindrical plastic mold spacers. In other exemplary embodiments, spacers 507*b* may comprise cylindrical metal spacers, wood spacers, fiber-glass spacers, paper spacers, cardboard spacers, or any other type of material that can replace a single magnet or multiple magnets within diametrically magnetized cylinder 506—including without limitation another magnet or magnetic cylinder. As mentioned above, the diametrically magnetized cylinder including the cylindrical plastic spacers may be configured in any sequence without deviating from the scope of the present invention. For example, and without limitation, the magnet and spacers may be alternating such as: a cylinder diametric magnet, cylinder plastic mold spacer, cylinder diametric magnet, cylinder plastic mold spacer, etc. Alternatively, the magnet and spacer configuration may entail: a cylinder diametric magnet, cylinder diametric magnet, cylinder plastic mold spacer, etc.

In an exemplary embodiment, diametrically magnetized cylinder 506 comprises a plurality of spacers 507*b* in-between a plurality of diametrically magnetized magnets, wherein each of the plurality of spacers and magnets is positioned such that a first spacer 507*x* is situated at a first terminal end of diametrically magnetized cylinder 506, followed by a pair of the plurality of magnets 507*a* sandwiched between spacer 507*x* and another of the plurality of spacers 507*b*, followed by several spacers 507*b* in-between other pairs of the plurality of diametrically magnetized magnets 507*a*, and terminating the sequence with a last spacer 507*y* situated at a second terminal end of diametrically magnetized cylinder 506.

Spine clamp 508 may be configured to engage with cover 501 and securely receive other components of magnetic assembly 502 in order to better secure magnetic assembly 502 to cover 501 of magnetic notebook 500. In exemplary embodiments, spine clamp 508 is tubular in shape and includes several structures. For example, and without limiting the scope of the present invention, an exemplary spine clamp 508 may include a cylindrical or tubular body with an elongated opening 509 along a length of the tubular body with disc end-caps 510 and 511 sealing up and supporting each terminal end of the tubular body. This design exemplarily snaps in place the covering hinge mount and diametrically magnetized cylinder together. This structure serves several purposes, including without limitation: to protect the overall structure of diametrically magnetized cylinder 506; to keep diametrically magnetized cylinder 506 secured within the binding—or more specifically channel 501*a*—of cover 501; to reduce a magnetic force thereby facilitating the detachment of pages 503; and to protect magnetic notebook 500 from other outside metals it may come in contact with so as to avoid unnecessarily attracting undesirable elements. Thus, spine clamp 508 renders magnetic notebook 500 safer and more practical for users by encapsulating parts of the magnetic binding safely and securely to the cover.

Hinge mount 512 may be implemented, as mentioned above, for added support of magnetic assembly 502. In exemplary embodiments, hinge mount 512 includes cavity 513 for receiving enclosure 505. In some embodiments, an entire enclosure 505 fits within cavity 513. In other embodiments, hinge support 512, may be smaller along a length of cavity 513 and a portion of enclosure 505 may stick outside of cavity 513. In exemplary embodiments, hinge mount 512 includes planar supports 514 and 515 adjacent and extending from a top surface of cavity 513, which may be adhered to a portion of cover 501 when fully assembled (see discussion below with reference to FIG. 5(*c*)).

A fully assembled magnetic assembly 502 of magnetic notebook 500 is depicted in FIG. 5(*b*). From this view, it may be appreciated that when fully assembled, magnetic assembly 502 lays substantially within channel 501*a* of cover 501 such that a top surface of the components of magnetic assembly 502 are generally flush with each interior cover surfaces 514*a* and 515*a* when in an open position as shown—this arrangement allows for improved arrangement of pages 503, facilitating their motion and generally the way pages 503 fit into the notebooks binding or magnetic assembly 505 whether magnetic notebook 500 is closed, or open (as shown). The next figure, FIG. 5(*c*), depicts a cross-sectional view of magnetic notebook 500 along the line segment A-A.

The cross-sectional view of FIG. 5(*c*) depicts how magnetic assembly 502 may be secured to cover 501 within channel 501*a*. More specifically, FIG. 5(*c*) shows diametrically magnetized cylinder 506 housed within enclosure 505, which sits substantially or entirely within cavity 513 of hinge mount 512. Hinge mount 512 sits securely and partially within opening 509 of spine clamp 508 (i.e. attached or adhered to an interior surface of opening 509 of spine clamp 508) such that an outer (bottom) surface 513*a* (i.e. see FIG. 5(*a*)) of hinge mount 512 rests against an interior surface of opening 509 of spine clamp 508. Accordingly, in the shown embodiment, the cavity of the hinge mount sits within the elongated opening along the length of the tubular spine clamp, sandwiched between the tubular spine clamp and the tubular enclosure. Moreover, as may be appreciated from this view, planar supports 514 and 515 of hinge mount 512 may extend outwards through opening 509 of spine clamp 508 (and extend outwards through channel 501*a* of cover 501) to lay flat against corresponding interior cover surfaces 514*a* and 515*a* (respectively) and in this manner typically adhered to an interior portion of cover 501.

In exemplary embodiments, an adhesive may be used to adhere spine clamp 508 to cover 501 (within channel 501*a*), as well as adhere the portion of hinge mount 512 that rests within opening 508 of spine clamp 508. A benefit of implementing hinge mount 512 is to hold spine clamp 508 in place, thereby bridging cover 501 and spine clamp 508 together, which allows for a full range of motion of the cover 501. Furthermore, an adhesive may be utilized to adhere these components together throughout the various surface areas of the components that contact each other. For example, and without limiting the scope of the present invention, an interior surface of channel 513 may be adhered to an outer surface of spine clamp 508; an interior surface of spine clamp 508 may be adhered to an outer surface 513*a* of hinge mount 512; and an interior surface 513*b* of hinge mount 512 may be adhered to an outer surface of enclosure 505. Naturally, care should be taken to leave a sufficient outer surface area of enclosure 505 exposed (clean of adhesive) so as not to obstruct the attachment of reattachable pages 503.

FIG. 5(*d*) depicts the direction of magnetic poles of a plurality of magnets along a magnetic binding in accordance with an exemplary embodiment of the present invention. More specifically, FIG. 5(*d*) depicts the direction of magnetic poles of a plurality of magnets along magnetic assembly 502 in accordance with an exemplary embodiment of the present invention. In this view, it can be appreciated that the highest point of each individual diametric magnet interchanging polarity (North or South) is preferably a vertical or z axis. For example, if both ends of cover 501 were to lay flat on a table or surface (as shown), the interchanging polarities of the magnetic tube would be directly facing up and down (as shown in FIG. 5(*d*)).

The configuration provided for in the exemplary embodiment of FIG. 5(*a*)-(*d*) is achieved in part by the various elements discussed above that secure the magnetic component to the cover. Moreover, adding cylinder plastic mold spacers in between the magnetic cylinders reduces the overall weight of magnetic notebook 500 and significantly reduces costs. The construction of the magnetic assembly and its coupling to the cover is desirable in that a balance of maintaining an adequate magnetic force to attract the pages is achieved, while minimizing that force so that other metal items near the magnetic book are not inadvertently attracted to the magnetic assembly. Lastly, this specific placement of the magnets provides a more even attraction or balance throughout the magnetic assembly in comparison to implementation of a single large cylindrical magnet. In the exemplary embodiment of FIG. 5(*d*), each of the plurality of spacers is positioned between a pair of diametrically magnetized cylindrical magnets having opposite directions of magnetic poles. That is, a first of the paired magnets may have a north pole facing upwards, while the second of each of the paired magnets may have a south pole facing upwards. Of course, as mentioned above, other arrangements and configurations are possible without deviating from the scope of the present invention.

To summate the advantages in the present disclosure of the magnetically bound media, the present invention provides the unique ability to remove and subsequently reattach pages to bound media, allowing for customization of information presentation, sequence, and selection. For instance, a student with homework from several heavy books may choose to only bring home the necessary pages from each book to complete that day's work. Due to the small size of the magnetic binding and the ability to remove pages altogether, the present invention has better functionality for both left and right-handed individuals. With respect to ringed bindings such as three-ring binders and spiral notebooks, the small size of the magnetic binding also affords a smaller minimum size and a quicker means with which to remove, rearrange, and reintegrate pages. Furthermore, the magnetic binding allows for pages to be removably secured in a more professionally presentable manner devoid of hole punches.

This invention can apply to any bound media and is thus widely applicable and, due to the strength of neodymium and samarium alloys, is also highly effective at securing pages in their desired place within the bound media. Moreover, due to the design of such magnetic alloys, the strength of the magnetic binding increases as more conductive pages are added, permitting its use in larger publications and projects. Additionally, the ability to remove and reintegrate pages from reused publications such as school textbooks paves the way for a more cost-effective means of replacing damaged media. Therefore, the present invention expands the versatility of bound media while simultaneously increasing functionality, professional aesthetic appeal, and long-term usage of said bound media.

Magnetically bound media with reattachable pages have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

DESCRIPTION OF REFERENCE SYMBOLS

100: Book
101: Front cover
102: Back cover
103: Magnetic binding
104: Spine
105: Magnet cover
106: Page
107: Adhered component
108: Magnet
200: Notebook
201: Front cover
202: Back cover
203: Magnetic binding
204: Spine
205: Binding clasp
206: Page
207: Adhered component
210: Integrated component
300: Notepad
301: Page
302: Adhered component
303: Support structure
304: Magnetic binding
305: Magnet
400: Notepad
401: Page
402: Adhered component
403: Support structure
404: Magnetic binding
405: Magnet
406: Clasp
500: Magnetic notebook
501: Cover
501*a*: Channel
501*b*: Spine
502: Magnetic assembly
503: Pages
504: Metallic component
505: Enclosure
506: Diametrically magnetized cylinder
507*a*: Magnets
507*b*: Spacers
507*x*: First Spacer
507*y*: Last Spacer
508: Spine clamp
509: Opening
510: End-cap
511: End-cap
512: Hinge mount
513: Cavity
513*a*: Outer surface
513*b*: Interior surface
514: Planar support
514*a*: Interior cover surface (front)
515: Planar support
515*a*: Interior cover surface (back)

What is claimed is:

1. A magnetic notebook, comprising:
a cover including a cylindrical channel along a spine of the cover;
a magnetic tube assembly housed within the cylindrical channel, including:
a tubular enclosure;
a diametrically magnetized cylinder housed within the tubular enclosure, the diametrically magnetized cylinder including a plurality of spacers in-between a plurality of diametrically magnetized cylindrical magnets;
a tubular spine clamp, with an elongated opening along a length of the tubular spine clamp, configured to snuggly receive the tubular enclosure within the elongated opening and engage with the cylindrical channel of the cover; and
a hinge mount including a cavity for receiving the tubular enclosure; and
a plurality of reattachable sheets of paper, each of the plurality of reattachable sheets of paper including a metallic strip configured to magnetically register with a surface of the magnetic tube assembly.

2. The magnetic notebook of claim 1, wherein each of the plurality of spacers is positioned between a pair of diametrically magnetized cylindrical magnets having opposite directions of magnetic poles.

3. The magnetic notebook of claim 1, wherein the tubular enclosure comprises a stainless-steel tube.

4. The magnetic notebook of claim 1, wherein the tubular enclosure comprises a tubular tape that surrounds the diametrically magnetized cylinder.

5. The magnetic notebook of claim 1, wherein the tubular enclosure comprises a thin foil tube.

6. The magnetic notebook of claim 1, wherein the tubular enclosure comprises a thin paper tube.

7. The magnetic notebook of claim 1, wherein each of the plurality of spacers comprise at least one material selected from the group consisting of plastic, fiber-glass, wood, and metal.

8. The magnetic notebook of claim 1, wherein each of the plurality of diametrically magnetized cylindrical magnets comprise of earth magnets.

9. The magnetic notebook of claim 1, wherein the tubular spine clamp comprises end caps to securely hold the tubular enclosure within the elongated opening.

10. The magnetic notebook of claim 1, wherein the hinge mount further includes planar supports adjacent to the cavity, the planar supports adhered to the cover with an adhesive.

11. The magnetic notebook of claim 1, wherein the cavity of the hinge mount sits within the elongated opening along the length of the tubular spine clamp, sandwiched between the tubular spine clamp and the tubular enclosure.

12. A magnetic notebook, comprising:

a cover;

a magnetic assembly housed within a channel of the cover, including a spine clamp configured to engage with the channel of the cover and an enclosure that houses a diametrically magnetized cylinder comprising a plurality of spacers in-between a plurality of diametrically magnetized magnets; and a plurality of reattachable sheets of paper, each of the plurality of reattachable sheets of paper including a metallic component configured to magnetically register with a surface of the magnetic assembly.

13. The magnetic notebook of claim 12, wherein each of the plurality of spacers is positioned between a pair of diametrically magnetized magnets having opposite directions of magnetic poles.

14. The magnetic notebook of claim 13, wherein the spine clamp includes an opening for snuggly receiving the enclosure.

15. The magnetic notebook of claim 14, further comprising a hinge mount including a cavity for receiving the enclosure.

16. The magnetic notebook of claim 15, wherein:

the hinge mount further includes planar supports adjacent to the cavity;

the cavity of the hinge mount sits within the opening of the spine clamp, sandwiched between the spine clamp and the enclosure; and the planar supports are adhered to the cover with an adhesive.

17. The magnetically bound notebook of claim 16, wherein the metallic component comprises a metallic strip.

18. A magnetic notebook, comprising:

a cover;

a magnetic assembly housed within a channel of the cover, the magnetic assembly including:

a plurality of diametrically magnetized magnets;

a plurality of spacers in-between the plurality of diametrically magnetized magnets, wherein each of the plurality of spacers is positioned between a pair of diametrically magnetized magnets having opposite directions of magnetic poles;

a spine clamp configured to engage with the channel of the cover; and a hinge mount including a cavity for receiving the plurality of diametrically magnetized magnets and the plurality of spacers in-between the plurality of diametrically magnetized magnets, and planar supports adjacent to the cavity, wherein the cavity of the hinge mount sits within an opening of the spine clamp and the planar supports are adhered to the cover with an adhesive; and a plurality of reattachable sheets of paper, each of the reattachable sheets of paper including a metallic strip configured to magnetically register with a surface of the magnetic assembly.

* * * * *